United States Patent [19]

Hayashi

[11] 4,158,418

[45] Jun. 19, 1979

[54] GOLF BALL COLLECTOR

[75] Inventor: Takeshi Hayashi, Naruto, Japan

[73] Assignee: Kyoei Zoki Kabushiki Kaisha, Naruto, Japan

[21] Appl. No.: 832,356

[22] Filed: Sep. 12, 1977

[30] Foreign Application Priority Data

Sep. 11, 1976 [JP] Japan ..... 51/109074

[51] Int. Cl.[2] ..... B60P 1/00

[52] U.S. Cl. ..... 414/440; 56/328 R

[58] Field of Search ..... 214/350, 351, 352, 353, 214/354, 355, 356; 56/328 R; 171/66, 78

[56] References Cited

U.S. PATENT DOCUMENTS

| | | | |
|---|---|---|---|
| 2,729,046 | 1/1956 | Patterson | 214/353 |
| 3,595,000 | 7/1971 | Recker | 214/356 |
| 3,995,759 | 12/1976 | Hollrock et al. | 214/356 |

*Primary Examiner*—Lawrence J. Oresky

*Attorney, Agent, or Firm*—Blanchard, Flynn, Thiel, Boutell & Tanis

[57] ABSTRACT

The present invention provides an improved golf ball collector, which comprises a plurality of ball catching wheels on a common axle which wheels are parallel with and spaced from each other so that the distance between two adjacent wheels is slightly smaller than the diameter of golf balls. In front of each of said wheels is arranged one disk wheel which is aligned therewith and which is slightly elevated off the ground and is rotated in the reverse direction relative to the direction of rotation of the ball catching wheels. Means is provided to deliver balls from the ball catching wheels to a container.

9 Claims, 11 Drawing Figures

GOLF BALL COLLECTOR

The present invention relates to a golf ball collector used specifically in a spacious golf training ground.

In such a golf training ground, heretofore golf balls scattered about on the ground have been collected by hand after business hours, which involves an enormous waste of time and much labor. This ball collecting cost has been one of the main causes not only for inflating the cost of balls but also for increasing the prices users must pay. Further, due to the fact that rainy or cold weather indisposes workers to do the ball collecting work, it has been difficult to employ such workers, which has been a serious problem from the management's standpoint.

Consequently, some ball collecting machines for collecting scattered balls by means of mechanical power have previously been proposed and put to practical use. A typical ball collecting machine generally employed nowadays is shown in FIGS. 1 and 2, and it will be explained in detail hereinafter.

Figure 1:
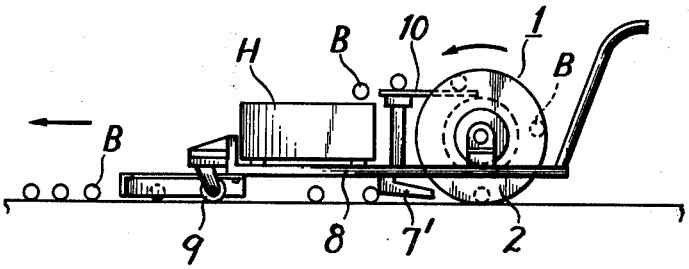
FIG. 1 PRIOR ART
FIG. 1 is a schematic side elevational view of a conventional golf ball collecting cart.
Figure 2:
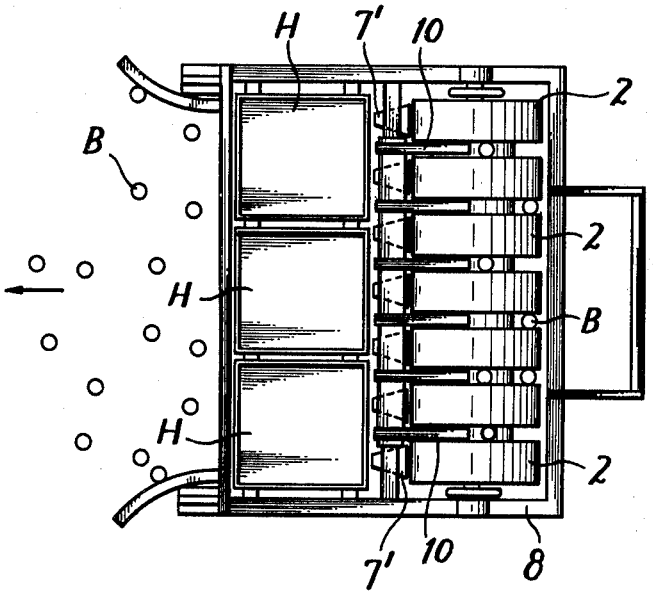
FIG. 2 PRIOR ART
FIG. 2 is a schematic plan view of the cart shown in FIG. 1.

Referring to the prior art apparatus illustrated in FIGS. 1 and 2, ball catching wheels (2),(2) which contact the ground are regularly spaced in parallel with each other in such a manner that the distance between two adjacent wheels is slightly smaller than the diameter of golf balls. These wheels (2),(2) are fixed to a common axle that is pivotally supported by a frame (8) at both its ends. The frame (8) is provided with casters (9) and it is further provided with stationary guide members (7') which are positioned in front of the ball catching wheels (2),(2). Ball delivery plates (10) are respectively arranged between two adjacent ball catching wheels (2),(2) in such a manner that the tip of the plate reaches close to the top of the hub of the wheels.

When a cart of this type is driven over golf balls (B), the balls are guided by the stationary guide members (7') into the space formed between two adjacent ball catching wheels (2),(2), the balls are picked up, held and raised by rotation of the ball catching wheels (2),(2).

The raised balls are scooped by ball delivery plates (10) and transferred into a container (H).

Such a conventional golf ball collecting cart as described above has an important drawback that the aforementioned stationary guide members (7') do not work well when the cart is moving fast or some of the scattered balls are received in depressions in the ground, because the stationary guide members (7'), which are slightly elevated off the ground level, run over the balls when they come into contact with them at a high speed. Thus in that case, those golf balls (B) that have passed under the stationary guide members (7') also pass under the ball catching wheels (2),(2) and raise them off the ground. At the moment when the ball catching wheels thus move upwardly, they lose their ability to pick up balls incidentally coming underneath them and consequently many balls (B) are left behind, so that the efficiency of the ball collecting is extremely lowered.

In order to eliminate such a drawback, a ball collecting cart in which each pair of two adjacent ball collecting wheels is movable upwardly and downwardly was proposed in the past, and yet when a large number of balls (B) are densely interspersed on the ground, all of the wheels (2),(2) are often raised by the balls (B) thereby reducing the ball picking-up efficiency and the same problem as mentioned above still remains unsolved.

Further, the reason why the performance of the stationary guide members (7') gets worse as the driving speed increases is that the moving speed of a ball (B) repelled after coming into contact with the guide member (7') is always smaller than the running speed of the ball catching wheels (2),(2) that follow, so that the wheels (2),(2) overtake and roll upon the ball (B). The higher is the relative speed between the golf ball (B) and the rolling wheels (2),(2), the larger is the percentage of the balls rolled on by the wheels.

Furthermore, in the case where the ball (B) is in a depression or the lower part of the ball sinks in the ground, the stationary guide members (7') pass on top of the ball (B) and raise the ball catching wheels (2),(2), whereby the wheels are also made ineffective.

Because of such drawbacks, the above-mentioned conventional golf ball collector leaves about 30%, on an average of the balls uncollected after a single pass of the collector, so repeated passes of the collector are required to collect them entirely, which has been extremely inconvenient. Moreover, even after the second pass, 9% of the initial number of balls remain uncollected and, therefore, not only the low efficiency but also the waste of time and money have been obstacles to efficient operation.

In view of the above-mentioned drawbacks of conventional ball collectors, the study of this inventor was directed to an improvement which ensures approximately 100% collection in a single pass of the collector, and the present invention has been accomplished.

Namely, the present invention has its object to provide an improved golf ball collector which makes it possible to collect about 100% of the golf balls in a single pass.

Another object of the present invention is to collect efficiently and economically widely scattered golf balls on a golf training ground.

The other objects of the present invention will be clearly understood from a reading of the following detailed explanation.

The aforesaid objects of the present invention can be attained by a golf ball collecting cart which comprises:

(1) a chassis comprising a horizontal beam and two side thills attached at a right angle to the said beam at their ends in such a manner that the thills extend rearwardly from said beam, (2) a ball catching unit comprising a plurality of ball catching wheels regularly spaced in parallel with each other in such a manner that the distance between two adjacent wheels is slightly smaller than the diameter of golf balls whereby the adjacent wheels are able to pick up and hold golf balls therebetween, said ball catching wheels having a common axle which is supported by the two free ends of the said thills, (3) a plurality of disk wheels, each of which is correspondingly aligned with one of the ball catching wheels, which disk wheels are regularly spaced in parallel with each other and are mounted on a common shaft supported by said thills with the axis of said shaft being parallel to and positioned in front of the said axle of the ball catching unit and which disk wheels are slightly elevated to leave a clearance between the disk wheels and the ground smaller than the diameter of golf balls.

(4) a ball collecting device comprising a reservoir for receiving collected balls and a ball delivery means to deliver balls from the ball catching unit to the reservoir, and (5) a driving means to rotate the disk wheels in the reverse direction relative to the direction of rotation of the ball catching wheels.

Figure 3:
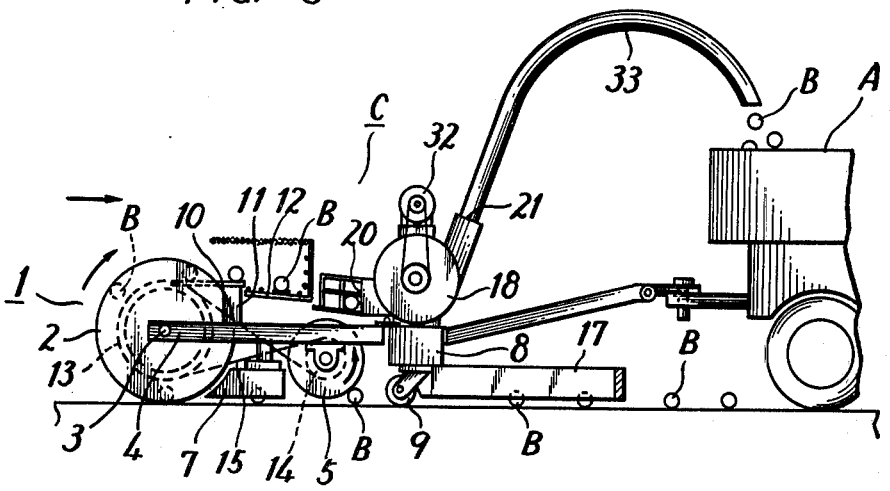
FIG. 3 is a schematic side elevational view of an embodiment of the present invention.
Figure 4:
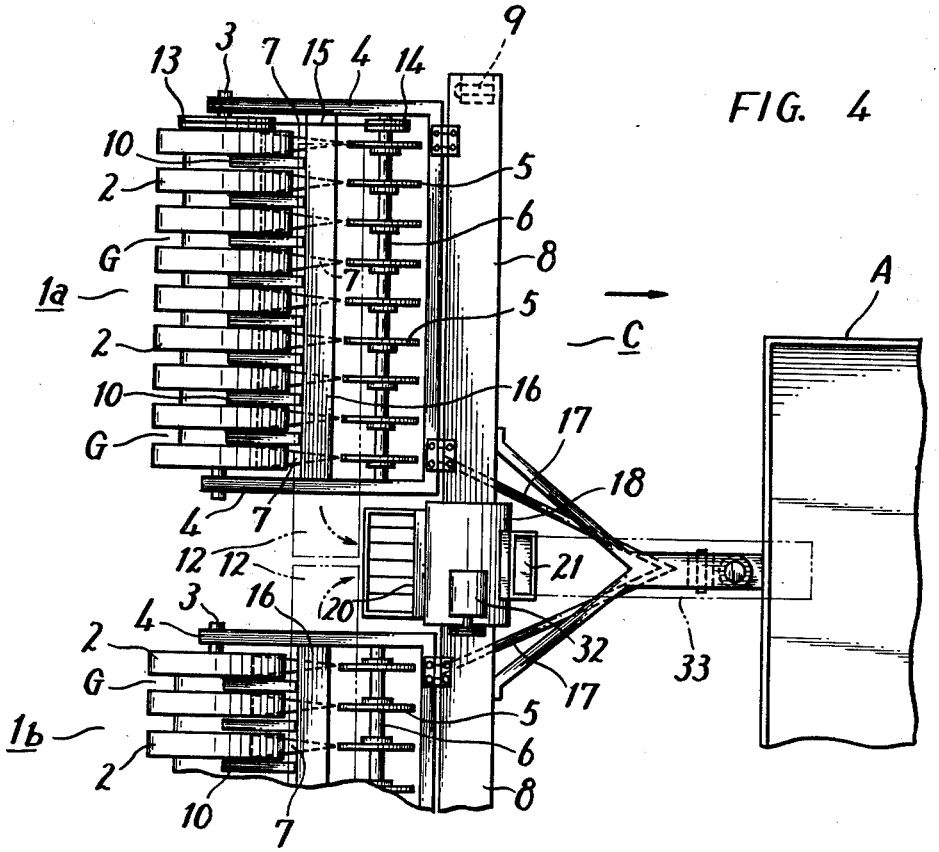
FIG. 4 is a schematic plan view of a fragment of the embodiment of the present invention as shown in FIG. 3.

A preferred embodiment of the golf ball collecting cart of the present invention and its important features will be explained in detail hereinafter with reference to the attached drawings. Referring to FIGS. 3 and 4, there is shown an automotive haul type ball collector according to the present invention which comprises a golf ball collecting cart (C) and a truck (A) having a container on its back and which truck can be driven in a golf training field while hauling the cart (C). In the ball collecting cart (C), the axles (3),(3) of ball catching units (1*a*) and (1*b*) are each pivotally supported respectively by and between the free ends of two side thills (4),(4), so that the ball catching units can roll on the ground. The side thills (4),(4) are attached at their other ends to a horizontal beam (8), preferably provided with casters (9),(9), so that the thills extend rearwardly from the beam (8). A golf ball collector which comprises a plurality of golf ball collecting carts arranged side by side can efficiently collect golf balls in a wide area during a single pass.

The aforementioned ball catching unit (1) comprises a plurality of ball catching wheels (2),(2) of the same size and mounted on a common axle (3) which is pivotally supported by and between two side thills (4),(4). The ball catching wheels (2),(2) are fixed in parallel on the common axle (3), with their being regular and equal spaces (G) formed by any two adjacent wheels, in such a manner that the distance between two adjacent wheels is slightly smaller than the diameter of golf balls. This construction permits the ball catching wheels to pick up and hold balls (B) by and between two adjacent wheels and to raise the balls (B) as the wheels rotate.

The ball catching wheels (2),(2) have their tread and side surfaces made of an elastic and abrasion-resistant material such as natural or synthetic rubbers, synthetic resins and the like. On the side surfaces of the wheel, concentric grooves (not shown in the drawings) may be formed to increase its ball holding effect.

Ball delivery plates (10) are mounted on a middle arm (11) which arm extends between two side thills (4),(4). The plates (10) are respectively arranged between two adjacent ball catching wheels (2),(2), extending into the spaces (G) formed between said adjacent wheels and close to the top of the hub of the wheels. Balls (B) moved upwardly by the ball catching wheels (2),(2) are picked up by the ball delivery plates (10) and delivered into a reservoir (12) which is installed transversely above and just in front of the ball catching unit (1).

The main feature of the ball collector of the present invention is a plurality of disk wheels (5),(5) which are arranged in front of the ball catching wheels (2),(2). Each of the disk wheels (5),(5) is correspondingly aligned with one of the ball catching wheels (2),(2), that is, the disk wheels (5),(5) are regularly spaced in parallel with each other at the same intervals as the ball catching wheels, keeping the distance between two adjacent disk wheels larger than the diameter of golf balls. The disk wheels (5) are fixed to a common shaft (6) which is supported by two side thills (4),(4) and in parallel with the axle (3) of the ball collecting unit (1).

All of the disk wheels (5),(5) are of identical size and are made of a thinner material as compared with the ball catching wheels (2),(2), e.g. steel plate. The thickness of the disk wheels (5),(5) is preferred to be as small as possible, provided that they do not damage golf balls when they rotate and come into contact with the balls.

The axle (3) and the shaft (6) are respectively provided on corresponding one ends thereof with pulleys (13) and (14) around which a driving belt is cross-belted whereby rotatory motion of the ball catching wheels (2),(2) rolling on the ground is reversely transmitted to the disk wheels (5),(5).

Further, the above-mentioned disk wheels (5),(5) are installed so as to be slightly elevated off the ground, leaving a clearance between themselves and the ground which clearance is smaller than the diameter of golf balls, most preferably to the extent that they do not touch the ground and yet they can touch balls (B) which are entirely or partly exposed on the ground.

Figure 5:
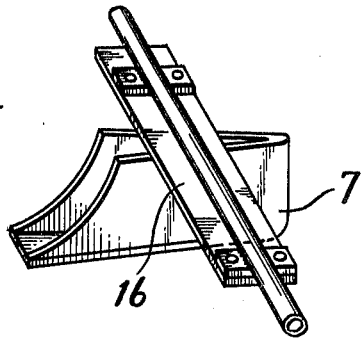
FIG. 5 is a perspective view of a guide member that can be used in the cart of the present invention.
Figure 6:
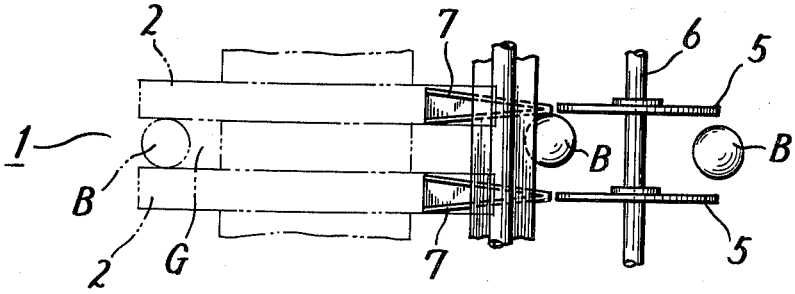
FIGS. 6 and 7 are respectively a plan view and a side elevational view, both showing the relative positions of the ball catching wheels, guide members and disk wheels contained in the cart of the present invention.
Figure 7:
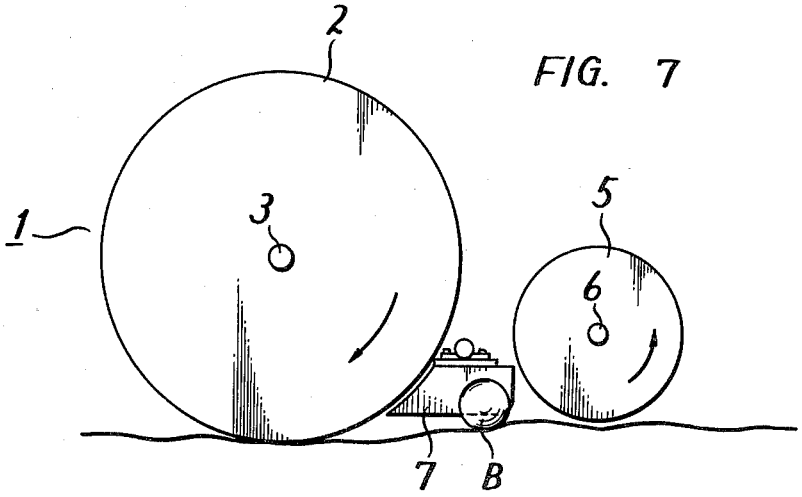

Between the ball collecting wheels (2),(2) and the disk wheels (5),(5), there are arranged stationary guide members (7),(7) which are also elevated off the ground in the same manner as the disk wheels (5),(5). Referring to FIGS. 5, 6 and 7 which show the contour and relative disposition of the stationary guide members (7),(7), the stationary guide members (7),(7) are fixed by welding or some other means to a transverse frame (16) which is supported by the side thills (4),(4), in such a manner that each of the guide members (7),(7) and each corresponding ball catching wheel (2) and disk wheel (5) are in alignment with each other in the running direction of the ball catching unit.

The end of the stationary guide member (7) facing its associated disk wheel 5 is formed into an edge, which is as thin as the disk wheel or slightly thinner than it. The other end of the guide member (7) facing the associated ball catching wheel (2) is approximately as wide as, but is slightly narrower than, the wheel (2). The upper rear edge of the guide member (7) has a concave shape which allows the guide member (7) to be set close to the wheel (2).

In the present invention, the above-mentioned stationary guide members (7),(7) can be omitted when disk wheels (5),(5) are arranged very close to ball catching wheels (2),(2).

To the horizontal beam (8) is fixed a plate (17) which projects forwardly to gather golf balls (B) on the bow and to bring them into the effective range of action of ball catching units (1*a*),(1*b*).

Figure 9:
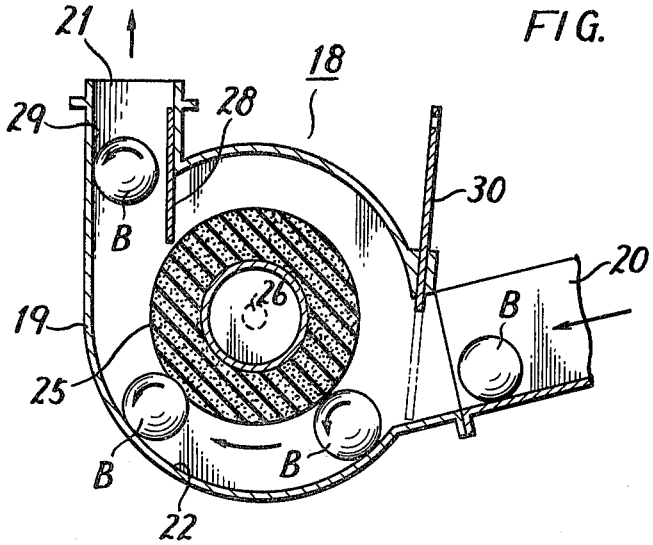
FIG. 9 is a schematic vertical cross-sectional side view of a ball shooting device that is employable in the present invention.
Figure 10:
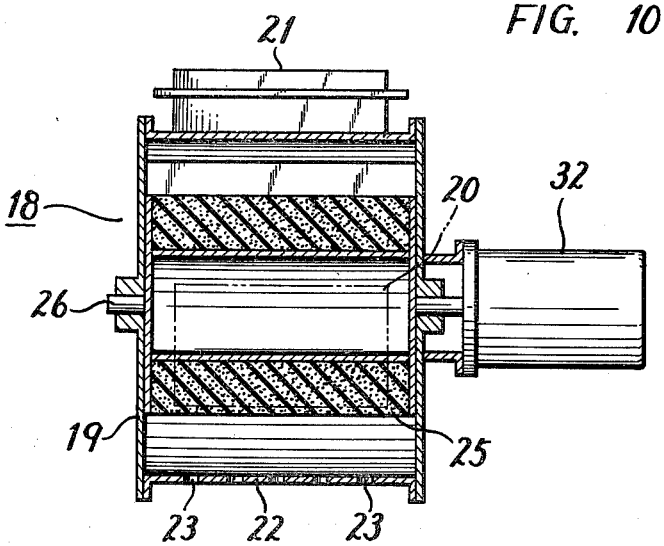
FIG. 10 is a schematic vertical cross-sectional front view of the ball shooting device as shown in FIG. 9.

Referring to FIGS. 9 and 10 which show the structure of a ball shooting device (18) mounted on the horizontal beam (8), it comprises a cylindrical casing (19) and a cylindrical rotor (25) concentrically enclosed in the said casing (19). Rotatory motion from motor (32) is mechanically transmitted to the axle (26) of the rotor (25). The casing (19) is formed of a tube having both its ends closed, and which is provided with an inlet (20) and an outlet (21) respectively on the lower side and upper side of its periphery. As the rotor (25) has a smaller diameter than that of the casing (19), an arcuate passage (22) is formed between the inner periphery of casing (19) and the rotor (25) and extending from the inlet (20) up to the outlet (21).

As shown in FIG. 10, the rotor (25) may be comprised of a steel pipe having flanges on both its ends. On the periphery of the pipe a resilient material such as natural or synthetic rubber and synthetic resin and the like is rolled and superimposed to provide the rotor with a predetermined diameter. The axle (26) of the rotor (25) is coupled with an electric motor (32) e.g., a bi-polar A.C. motor which is supplied with current so that the rotor may be rotated at a speed of about 2,000 revolutions per minute. The direction of the rotation is selected so that balls can be conveyed through the curved passage (22) from the inlet (20) towards the outlet (21) as arrow-indicated in FIG. 9.

In the ball shooting device having a structure as described above, the curved passage (22) formed between the inner periphery of casing (19) and the outer periphery of rotor (25) necessarily has such a dimension that golf balls (B) can be slightly pressed by and between the casing (19) and rotor (25) and forced to roll through the curved passage (22). For this purpose, the distance in the normal direction between the casing (19) and the concentrically enclosed rotor (25), in other words, the normal thickness of the curved passage (22) is slightly smaller than the diameter of golf balls (B). Further, such a device may have the periphery near the outlet (21) of the casing (19) extending to the tangential direction to form a wall (29) and also may have a partition wall (28) extending close to the rotor (25) and facing the above-mentioned wall (29) with a space wide enough to allow balls (B) to pass through freely. Furthermore, it may comprise a damper (30) installed on the casing (19) to open and close the inlet (20).

Operation of an embodiment of the ball shooting device as described above will be explained below.

In the case where such a device is used to collect scattered golf balls (B) on a golf training ground, it is arranged behind a truck (A) having a container on its back and in front of the ball catching units (1) hauled by the truck (A) as shown in FIG. 3, and then the inlet (20) is connected with a ball delivery opening provided at the bottom of reservoir or chute (12) while the outlet (21) is connected with a duct (33) having its free open end directed to the container on the truck (A).

Electric current is supplied to the motor (32) to rotate the rotor (25) and when its rotation has reached a required number e.g., approximately 2,000 revolutions per minute, the damper (30) is opened and then balls (B) are introduced from the delivery opening of the reservoir or chute (12) into the casing (19) through the inlet (20). The balls travel between the inner periphery of the casing (19) and the outer periphery of the rotor (25) are shifted, rolling in a direction as shown by arrows in FIGS. 9, towards the outlet (21). Just before balls (B) reach the outlet (21), the running direction of the balls is regulated by the partition wall (28) and then balls (B) set free are shot out of the outlet (21) at an initial speed of about 6–8 meters per second, run through the duct (33) and fall down into the container.

Having conducted various experiments with respect to ball transferring using this type of ball shooting device, the inventor has confirmed the fact that a constant rotatory speed of rotor (25) provides a shot-out ball with a constant initial speed, and therefore, if once the open end of the duct connected at the other end with the outlet (21) has been set, the shooting direction of the ball is precisely controlled. In that case, only a function for determining the direction is required for the duct regardless of its length. In an extreme case, even when the outlet (21) without any duct is directed to a target, the falling point of balls (B) is always constant, for instance, the fact has been proved that, in the above manner, 100% of the shot balls can be thrown into a basket of 30 cm diameter placed 5 meters therefrom.

In the operation of the automotive hauling type golf ball collector of the present invention having a structure as described above, when the line of travel of a running disk wheel deviates even a little from the center of a ball coming into contact with the disk wheel, the disk wheel can naturally act to move the ball aside and introduce it into a holding space of the ball catching unit. As is rotating reversely to the running direction of the cart, the disk wheel functions to make a contacted ball to roll forwardly, which is a principal feature of the present invention. Now, referring to FIG. 8, the rotation of the disk wheel (5) as shown by an arrow imparts rotation also shown by an arrow to the ball (B) when the ball contacts the wheel, so that the ball (B) is driven forwardly by virtue of its resilience and revolution at the moment of contact. It will be clearly understood that if the initial velocity of a rolling ball is larger than a running velocity of ball catching wheels (2),(2), those wheels (2),(2) never reach and run over the ball.

Figure 8:
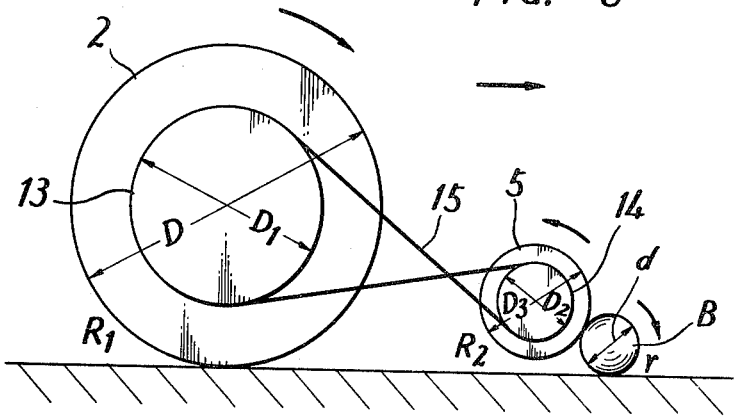
FIG. 8 is a diagram illustrating the relative positions and sizes of the ball catching wheels, disk wheels and golf balls in the present invention.

The running speed of a golf ball imparted by a disk wheel is calculated by the following equations with reference to various parameters shown in FIG. 8.

$$S_1=\pi dr \quad (1)$$

where $S_1$ is the initial running speed of a golf ball (B) and r is a number of rotations of the ball. The relation between the number of rotations (r) and the number of rotations ($R_2$) of a disk wheel (5) is represented by the following equations, provided that slippage between the wheel and the ball is negligible.

$$rd=R_2D_3$$

therefore, $$r=(D_3/d)R_2 \quad (2)$$

The relation between the number of rotations ($R_2$) of the disk and the number of rotations ($R_1$) of the ball catching wheels (2) is given by the following equations.

$$R_2D_2=R_1D_1$$

therefore, $$R_2=(D_1/D_2)R_1 \quad (3)$$

Substituting the equation (1) by equations (2) and (3), the following equation (4) is derived.

$$S_1=(\pi \cdot D_3 \cdot D_1 \cdot R_1)/D_2 \quad (4)$$

On the other hand, the running speed (S) of the ball catching wheels (2),(2) is given by the following equation.

$$S=\pi D R_1 \quad (5)$$

Now, when the running speed of a golf ball (B) is at least equal to the running speed of ball catching wheels (2), the wheels (2) never catch up with the ball (B) and therefore, if the following equation derived by equations (1) and (5) is satisfied, the aforementioned objects can of course be attained.

In the case when golf balls are collected with the above-mentioned automotive hauling type ball collector of the present invention, golf balls (B) existing in front of the running collector at first come into contact with rotating disk wheels (5) by which a rotatory motion is imparted to the balls to cause them to run faster than the collector and accordingly, ball collecting wheels (2) never run over those balls. Other balls which have not touched the disk wheels (5) pass through between them and are caught by the ball catching wheels (2), or after their positions have been regulated by the stationary guide members (7), they are caught by the ball catching wheels (2). Therefore, the ball catching wheels (2) are never pushed up, so that substantially 100% of golf balls (B) can be collected at a single pass of the collector, which effects saving of time and labor and decreases damage of grass planted on the ground.

Further, when a ball (B) having its lower part sunk in the ground comes into contact with a disk wheel (5), the rotating wheel (5) imparts a rotatory motion to the ball, so that it jumps out of the depression and rolls forwardly, whereafter it is collected by a ball collecting unit (1). Thus, the collecting efficiency extremely improves as compared with a conventional ball collector.

Figure 11:
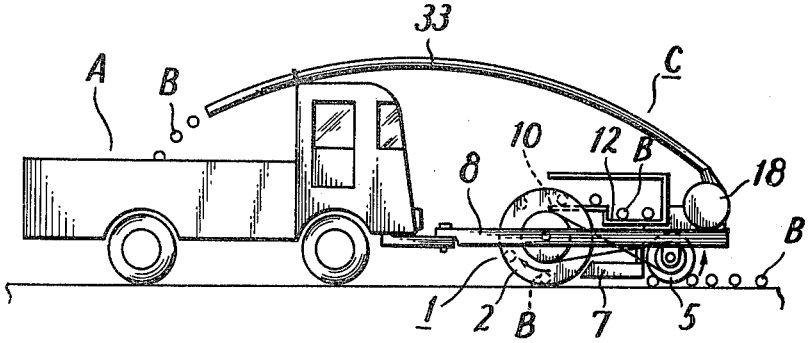
FIG. 11 is a schematic side elevational view of another embodiment of the present invention.

In FIG. 11 shown is an automotive pushing type golf ball collector of the present invention which comprises a golf ball collecting cart and a truck (A) provided with a container on its back which pushes the collecting cart. This type collector has such advantages that it is possible to collect balls (B) in the rearmost container by utilizing the aforementioned ball transferring means, the driver can watch and check simultaneously the conditions of the ground ahead and the performance of the collecting work, and further, the wheels of the truck (A) never tread on and bury balls in the ground before collecting.

As explained above in detail, the golf ball collecting cart of the present invention comprises disk wheels (5),(5) paired with ball catching wheels (2),(2). The disk wheels 5,5 are arranged in front of a ball catching unit (1) in such a manner that the common shaft of the disk wheels is in parallel with the axle of the ball catching unit (1) and disk wheels (5),(5) are slightly elevated off the ground and are caused to rotate in a reverse direction relative to the direction of rotation of the ball catching wheels (2),(2). Therefore, golf balls (B) present in front of the ball catching wheels (2),(2), even if some them are depressed in the ground, are given a rotatory motion by disk wheels 5 to drive the balls forwardly, in so far as the balls contact the disk wheels (5). Thus, since only those balls (B) which would otherwise cause raising of ball catching wheels (2) are propelled ahead of the ball catching wheels and all other balls (B) can be entirely collected by a single pass of the ball catching unit (1), the efficiency of ball collecting will so much improved that saving of working time and maintenance cost of ball collectors can be achieved and accordingly the ball collecting cost will be lowered as compared with conventional collectors. In addition, as there happens no instance in which the ball catching unit (1) is lifted by balls, the collector of the present invention can perform almost perfect ball collection even in an area where many balls exist densely, so that the golf ball collector of the present invention is very useful because it has a high efficiency in comparison with conventional ball collectors which have a low efficiency.

Further, as explained hereinbefore, an automotive pushing type collector has the advantages that the driver can watch the conditions of the ground ahead simultaneously with the performance of ball collecting and the wheels of the pulling vehicle never tread on balls before collecting, so that the efficiency further improves.

Furthermore, according to the present invention, since the stationary guide members (7) may be arranged between the disk wheels (5) and the ball catching wheels (2), the disadvantages that balls (B) having passed between two adjacent disk wheels (5) are otherwise to be treaded under ball catching wheels (2) which result in lifting of the ball catching wheels (2), are entirely eliminated. Thus, not only is the efficiency further improved, but also it is possible to make the tread of the ball catching wheels (2) wider so as to provide a ball collector with improved durability and stability.

As explained hereinbefore, the present invention can provide a golf ball collector with an extremely high efficiency together with a certainty of ball collecting even when it is run at high speed, which enables rationalization of the administration of golf training business owing to saving of labor. Further, the lowering of ball hiring cost realized by the present invention will be advantageous.

What is claimed is:

1. A golf ball collecting cart which comprises:

(1) a chassis comprising a horizontal beam and two side thills attached at their forward ends to said beam and extending at a right angle to said beam in such a manner that said thills extend rearward from said beam, (2) a ball catching unit comprising a plurality of ball catching wheels regularly spaced in parallel with each other in such a manner that the distance between two adjacent wheels is slightly smaller than the diameter of golf balls whereby adjacent wheels are able to pick up and hold golf balls therebetween, said ball catching wheels having a common axle which is supported by the rearward ends of said thills, (3) a plurality of disk wheels, each of which is correspondingly aligned with one of the ball catching wheels, said disk wheels being regularly spaced in parallel with each other with the distance between two adjacent disk wheels being larger than the diameter of golf balls, said disk wheels being mounted on a common shaft supported by said thills with the axis of said shaft being parallel to and positioned in front of said axle of the ball catching unit, said disk wheels being slightly elevated to provide a clearance between said disk wheels and the ground smaller than the diameter of golf balls, (4) a ball collecting device comprising a reservoir to receive collected balls and a ball delivery means to deliver balls from said ball catching unit to said reservoir, and (5) a driving means to rotate said disk wheels in the reverse direction relative to the direction of rotation of said ball catching wheels.

2. A golf ball collecting cart as claimed in claim 1 wherein said driving means is a motion transmitting mechanism which transmits rotatory motion of said ball catching wheels to said disk wheels.

3. A golf ball collector which comprises a golf ball collecting cart and a motor vehicle connected to said cart for moving said cart along the ground, said cart comprising, (1) a chassis comprising a horizontal beam and two side thills attached at their forward ends to said beam and extending at a right angle to said beam in such a manner that said thills extend rearward from said beam, (2) a ball catching unit comprising a plurality of ball catching wheels regularly spaced in parallel with each other in such a manner that the distance between two adjacent wheels is slightly smaller than the diameter of golf balls whereby adjacent wheels are able to pick up and hold golf balls therebetween, said ball catching wheels having a common axle which is supported by the rearward ends of said thills, (3) a plurality of disk wheels, each of which is correspondingly aligned with one of the ball catching wheels, said disk wheels being regularly spaced in parallel with each other with the distance between two adjacent disk wheels being larger than the diameter of golf balls, said disk wheels being mounted on a common shaft supported by said thills with the axis of said shaft being parallel to and positioned in front of said axle of the ball catching unit, said disk wheels being slightly elevated to provide a clearance between said disk wheels and the ground smaller than the diameter of golf balls, (4) a ball collecting device comprising a reservoir to receive collected balls and a ball delivery means to deliver balls from said ball catching unit to said reservoir, and (5) a driving means to rotate said disk wheels in the reverse direction relative to the direction of rotation of said ball catching wheels.

4. A golf ball collector as claimed in claim 3 wherein said motor vehicle is a truck having a container on its back, and including a ball transferring means for transferring collected balls from said reservoir into said container.

5. A golf ball collector as claimed in claim 4 wherein said ball transferring means is a ball shooting device comprising a cylindrical casing having an inlet on the lower side and an outlet on the upper side of its periphery, a cylindrical rotor having a resilient surface which is concentrically mounted in said casing to form around the rotor a curved passage extending between said inlet and said outlet, said passage having a uniform normal space slightly smaller than the diameter of golf balls and a driving means for rotating said rotor thereby to carry golf balls from said inlet through said passage to said outlet.

6. A golf ball collecting cart as claimed in claim 1, which further comprises a plurality of stationary guide members installed between said ball catching wheels and said disk wheels, each of said guide members being correspondingly aligned with one of said disk wheels and being slightly elevated to leave a clearance between said guide members and the ground smaller than the diameter of golf balls.

7. A golf ball collector according to claim 3 in which said cart is positioned behind said motor vehicle so that said motor vehicle is adapted to haul said cart.

8. A golf ball collector according to claim 3 in which said cart is positioned in front of said motor vehicle so that said motor vehicle is adapted to push said cart.

9. A golf ball collector which comprises a horizontal beam having a plurality of chassis attached thereto in side-by-side relation thereon, each of said chassis comprising (1) two side thills attached at their forward ends to said beam and extending at a right angle to said beam in such a manner that said thills extend rearward from said beam, (2) a ball catching unit on the chassis, the ball catching unit comprising a plurality of ball catching wheels regularly spaced in parallel with each other in such a manner that the distance between two adjacent wheels is slightly smaller than the diameter of golf balls whereby adjacent wheels are able to pick up and hold golf balls therebetween, said ball catching wheels having a common axle which is supported by the rearward ends of said thills of the chassis, (3) a plurality of disk wheels, each of which is correspondingly aligned with one of the ball catching wheels, said disk wheels being regularly spaced in parallel with each other with the distance between two adjacent disk wheels being larger than the diameter of golf balls, said disk wheels being mounted on a common shaft supported by said thills of the chassis with the axis of said shaft being parallel to and positioned in front of said axle of the ball catching unit, said disk wheels being slightly elevated to provide a clearance between said disk wheels and the ground smaller than the diameter of golf balls, (4) a ball collecting device comprising a reservoir to receive collected balls and a ball delivery means to deliver balls from said ball catching unit to said reservoir, and (5) a driving means to rotate said disk wheels in the reverse direction relative to the direction of rotation of said ball catching wheels.

* * * * *